US008754739B2

(12) United States Patent
Inaba

(10) Patent No.: US 8,754,739 B2
(45) Date of Patent: Jun. 17, 2014

(54) REACTOR

(75) Inventor: Kazuhiro Inaba, Osaka (JP)

(73) Assignee: Sumitomo Electric Industries, Ltd., Osaka-shi (JP)

( * ) Notice: Subject to any disclaimer, the term of this patent is extended or adjusted under 35 U.S.C. 154(b) by 0 days.

(21) Appl. No.: 13/809,372

(22) PCT Filed: Jul. 5, 2011

(86) PCT No.: PCT/JP2011/065333

§ 371 (c)(1),
(2), (4) Date: Jan. 9, 2013

(87) PCT Pub. No.: WO2012/008328

PCT Pub. Date: Jan. 19, 2012

(65) Prior Publication Data

US 2013/0114319 A1 May 9, 2013

(30) Foreign Application Priority Data

Jul. 13, 2010 (JP) ..... 2010-159159
Jul. 4, 2011 (JP) ..... 2011-148682

(51) Int. Cl.

| | |
|---|---|
| ***H01F 17/04*** | (2006.01) |
| ***H01F 27/08*** | (2006.01) |
| ***H01F 27/02*** | (2006.01) |
| ***H01F 27/24*** | (2006.01) |
| ***H01F 27/28*** | (2006.01) |
| ***H01F 27/30*** | (2006.01) |

(52) U.S. Cl.
USPC ..... 336/221; 336/61; 336/90; 336/92; 336/212; 336/223; 336/208; 336/205

(58) Field of Classification Search
USPC ..... 336/90, 92, 212, 208, 205, 233, 221, 336/222, 61
See application file for complete search history.

(56) References Cited

U.S. PATENT DOCUMENTS

| | | | | |
|---|---|---|---|---|
| 5,382,937 | A * | 1/1995 | Saitoh et al. | 336/178 |
| 7,911,308 | B2 * | 3/2011 | Rippel | 336/182 |
| 2007/0052510 | A1 * | 3/2007 | Saegusa et al. | 336/92 |

(Continued)

FOREIGN PATENT DOCUMENTS

| | | | |
|---|---|---|---|
| JP | 04-049608 | A * | 2/1992 |
| JP | 2003-168610 | | 6/2003 |

(Continued)

*Primary Examiner* — Alexander Talpalatski
*Assistant Examiner* — Mangtin Lian
(74) *Attorney, Agent, or Firm* — Venable LLP; Michael A. Sartori; Tamatane J. Aga

(57) ABSTRACT

A reactor having a good heat dissipation effect is provided. The reactor includes one coil formed by winding a wire, a magnetic core arranged inside and outside the coil and forming a closed magnetic circuit, and a case for housing an assembly of the coil and the magnetic core. An end surface of the coil has a race track shape, and the coil is housed in the case such that the axial direction of the coil is parallel to an outer bottom surface of the case. A part of an outer peripheral surface of the coil is covered with the magnetic core (outer core portion), and a remaining part thereof not covered with the magnetic core is contacted with an inner bottom surface of the case. Since a part (mainly a linear portion) of the outer peripheral surface of the coil is directly contacted with the inner bottom surface of the case, heat of the coil can be directly dissipated such that the heat is released through the case to an installation target, e.g., a water cooling base, on which the case is installed. Thus, the reactor has a good heat dissipation effect.

9 Claims, 5 Drawing Sheets

(56) References Cited

U.S. PATENT DOCUMENTS

2008/0304298 A1* 12/2008 Toba et al. ..... 363/56.01

FOREIGN PATENT DOCUMENTS

| | | | |
|---|---|---|---|
| JP | 3794928 | | 4/2006 |
| JP | 2006-261331 | A | 9/2006 |
| JP | 2007-243131 | | 9/2007 |
| JP | 2009-033051 | A | 2/2009 |
| JP | 2009-253105 | | 10/2009 |
| JP | 2010-283119 | | 12/2010 |
| JP | 4737477 | | 5/2011 |
| WO | WO-2009/125593 | A1 | 10/2009 |

* cited by examiner

REACTOR

TECHNICAL FIELD

The present invention relates to a reactor used as a component of a power conversion device, e.g., a vehicle-loaded Direct Current (DC)-DC converter, a converter including the reactor, and a power conversion device including the converter. More particularly, the present invention relates to a reactor having a good heat dissipation effect.

BACKGROUND ART

There is a reactor as one of parts of a circuit for performing operations of stepping-up and -down a voltage. In one form of a reactor employed, for example, in a converter that is loaded on a vehicle such as a hybrid car, a pair of coils, each formed by spirally winding a wire, are disposed side by side around respective portions of a magnetic core having a annular shape, e.g., an O-like shape (Patent Literature (PTL) 1).

A small reactor including only one coil is also known like a reactor disclosed in PTL 2. Such a reactor includes, as illustrated in FIG. 1 of PTL 2, the so-called pot type core, i.e., a magnetic core including a columnar inner core portion arranged inside a coil, a cylindrical core portion covering substantially an entire outer peripheral surface of the coil, and a pair of disk-shaped core portions arranged at respective end surfaces of the coil. In the pot type core, the concentrically-arranged inner core portion and cylindrical core portion are coupled to each other by the disk-shaped core portions, thereby forming a closed magnetic circuit.

CITATION LIST

Patent Literature

PTL 1: International Publication WO2009/125593
PTL 2: Japanese Unexamined Patent Application Publication No. 2009-033051

SUMMARY OF INVENTION

Technical Problem

During operation of a reactor, because a coil generates heat with energization, the coil and a magnetic core are subjected to high temperature. In particular, a vehicle-loaded reactor generates heat in a larger amount than that generated by a reactor used in an ordinary electronic component. Therefore, the vehicle-loaded reactor is usually employed in a state fixed to an installation target provided with a cooling function, e.g., to a water cooling base.

Consider, for example, the case where the above-described reactor including the pot type core is fixed to the installation target with the axial direction of the coil being perpendicular to a surface of the installation target (such an arrangement is called a vertical layout hereinafter). In the vertical layout, only the end surface of the coil is positioned close to the installation target, and distances from other regions of the coils to the installation target are long. Therefore, a region of the coil positioned close to the installation target is small, and heat of the coil is less transferable to the installation target. It is hence cannot be said that the vertical layout provides a sufficient heat dissipation effect.

Consider, as another example, the case where the above-described reactor including the pot type core is fixed to the installation target with the axial direction of the coil being parallel to the surface of the installation target (such an arrangement is called a horizontal layout hereinafter). In that case, when the end surface of the coil has the shape of a true circle as disclosed in PTL 2, only one linear line defining the outer peripheral surface of the coil 2 is positioned close to the installation target. Therefore, a region of the coil positioned close to the installation target is small as in the above-described vertical layout. It is hence cannot be similarly said that the horizontal layout provides a sufficient heat dissipation effect.

In particular, when a portion of the magnetic core 3, which covers the outer peripheral surface of the coil, is formed of a molded and hardened body containing magnetic powder and resin as disclosed in PTLs 1 and 2, the heat dissipation effect degrades if the resin inferior in thermal conductivity to the magnetic powder made of, e.g., iron is excessively present between the coil and the installation target.

Furthermore, when substantially the entire outer peripheral surface of the coil is covered with the magnetic core similarly to the pot type core, such a reactor cannot be said as having a sufficient heat dissipation effect although heat of the coil is released to the outside through the magnetic core. It is hence demanded to develop a reactor including one coil and having a structure that ensures a good heat dissipation effect.

Accordingly, an object of the present invention is to provide a reactor having a good heat dissipation effect. Another object of the present invention is to provide a converter including the reactor, and a power conversion device including the converter.

Solution to Problem

The present invention achieves the above object by providing a structure in which a coil has a particular shape, the reactor includes a case serving as a heat dissipation path, and a part of an outer peripheral surface of the coil is contacted with the case.

The reactor of the present invention comprises one coil formed by winding a wire, a magnetic core arranged inside and outside the coil and forming a closed magnetic circuit, and a case for housing an assembly of the coil and the magnetic core. The coil has the following features (1) to (3).

(1) The coil has an end surface shape that is non-circular and that includes a curved portion.

(2) The coil is housed in the case with an axial direction of the coil being parallel to an outer bottom surface of the case, the outer bottom surface being cooled by an installation target.

(3) A part of an outer peripheral surface of the coil is covered with the magnetic core, and at least a portion of a remaining part thereof not covered with the magnetic core is contacted with an inner bottom surface of the case.

The magnetic core includes an inner core portion arranged inside the coil, and an outer core portion covering the part of the outer peripheral surface of the coil. The inner core portion is formed of a powder compact, and the outer core portion is made of a mixture of magnetic powder and resin.

In the reactor of the present invention, as described above, only the part of the outer peripheral surface of the coil is covered with the magnetic core to form the closed magnetic circuit instead of covering substantially the entirety of the outer peripheral surface (i.e., surfaces of plural layered turns) of the coil, and at least another part of the outer peripheral surface of the coil is contacted with the case. Particularly, in the reactor of the present invention, the end surface shape of the coil is non-circular instead of being a true-circular shape, and the coil is arranged in the horizontal layout. With such an arrangement, the reactor of the present invention can increase a contact area between the outer peripheral surface of the coil and the inner bottom surface of the case, and can increase a region of the case where the distance to the inner bottom surface of the case is short, i.e., a region of the case, which region is positioned close to the installation target having a cooling function. According to the reactor of the present invention, therefore, heat of the coil can be directly transferred to the case with high efficiency, and the heat is conducted to the installation target through the outer bottom surface of the case, the outer bottom surface being contacted with the installation target and cooled by the installation target, thus resulting in a good heat dissipation effect. Furthermore, since the reactor of the present invention includes one coil unlike the reactor of PTL 1 including a pair of coils, the reactor size is reduced. Since the end surface of the coil has a flattened shape instead of a true-circular shape, it is easier to, in comparison with a coil having an end surface shape of a true circle, to reduce the height of the coil (i.e., the size of the coil in the direction of a diameter of the true circle). That point contributes to reducing the reactor size. Moreover, with the reactor of the present invention, since the end surface shape of the coil includes the curved portion, the coil can be easily formed.

According to the reactor of the present invention, since the end surface shape of the coil includes a linear portion and the curved portion, the coil can be more easily formed and can be manufactured with higher productivity than the coil including only the linear portion, which is described in PTL 1. Furthermore, according to the reactor of the present invention, since the outer core portion is made of the above-mentioned mixture, the outer core portion can be easily formed by placing the coil into the case in a state where the part of the outer peripheral surface of the coil is contacted with the inner bottom surface of the case, filling the mixture into the case, and then hardening the resin of the mixture. Here, the magnetic core used in the reactor may be formed of a stack that is obtained by stacking a plurality of electric steel sheets, a powder compact that is obtained by compacting magnetic powder under pressure, a molded and hardened body that is made of the above-mentioned mixture of magnetic powder and resin, or a combination of the formers (called a hybrid core hereinafter). In particular, because the power compact can be easily formed even when it has a complicated three-dimensional shape, the inner core portion and the outer core portion may be both formed of powder compacts. However, the reactor of the present invention is constructed in such a complicated shape that the part of the outer peripheral surface of the coil, which has the desired shape and is housed in the case, is covered with a part (outer core portion) of the magnetic core. By forming the outer core portion using the above-mentioned mixture, the outer core portion can be more easily formed even in such a complicated shape in comparison with the case where the outer core portion is formed of the stack of the electric steel sheets or the powder compact. When the outer core portion is formed of the above-mentioned mixture, the outer core portion having the desired magnetic characteristics (mainly inductance) and the magnetic core including that outer core portion can be easily formed because a mixing ratio of the magnetic powder and the resin can be easily changed. Those points enable the reactor of the present invention to exhibit good productivity.

Since the outer core portion is formed of the above-mentioned mixture, the inner core portion and the outer core portion can be integrated with each other by the resin of the mixture. Such a form can eliminate the need of a step of bonding both the core portions and the use of a bonding material (e.g., an adhesive or a bonding tape), and can reduce the number of components and the number of steps. Moreover, according to the above-described form, the reactor can be manufactured through the steps of placing an assembly of the coil and the inner core portion into the case, and molding the outer core portion so as to cover the part of the outer peripheral surface of the coil, for example, at the same time as forming the magnetic core with predetermined characteristics. Those points also enable the reactor of the present invention to exhibit good productivity.

In addition, according to the reactor of the present invention, since the inner core portion is formed of the powder compact, the inner core portion can be easily formed, for coils having various inner peripheral shapes, so as to have an outer shape following the inner peripheral shape of each of the coils. By forming the outer shape of the inner core portion to be analogous to the inner peripheral shape of the coil, the outer peripheral shape of the inner core portion and the inner peripheral shape of the coil can be positioned close to each other, and the reactor size can be further reduced.

In the case of the hybrid core in which the inner core portion and the outer core portion are made of different materials, magnetic characteristics of both the core portions can be made different from each other. In an exemplary form, the saturation magnetic flux density of the inner core portion can be made higher than that of the outer core portion by selecting appropriate materials. According to such a form, a cross-sectional area of the inner core portion can be reduced in comparison with the case where the saturation magnetic flux density is uniform over the entire magnetic core as described in PTL 1. With a smaller sectional area of the inner core portion, a circumferential length of the coil can also be shortened. Thus, the above-mentioned form contributes to reducing the size, weight, and loss.

In an alternative form, the magnetic permeability of the outer core portion can be made lower than that of the inner core portion by selecting appropriate materials. Such a form can provide a gapless structure or can further reduce the size of the inner core portion. Herein, typical magnetic materials used for a magnetic core of a reactor have correlation between the saturation magnetic flux density and the relative magnetic permeability. In many cases, a magnetic material having a higher saturation magnetic flux density has a higher relative magnetic permeability. Accordingly, when the saturation magnetic flux density of the entire magnetic core is high, the relative magnetic permeability also tends to become high. Thus, the magnetic core is required to include a gap for inhibiting saturation of magnetic flux, e.g., a gap member made of a material having a lower magnetic permeability than the magnetic core, typically made of a nonmagnetic material, or an air gap. When the gap is included in the magnetic core, it is desired to provide a certain clearance between the inner peripheral surface of the coil and the outer peripheral surface of the inner core portion in order to suppress leakage flux through the gasp and to reduce the loss caused upon the leakage flux reaching the coil. In the case of the gapless structure, the core size can be reduced corresponding to omission of the gap. Moreover, since the above-mentioned clearance can be reduced by arranging the coil and the inner core portion closer to each other, a smaller reactor can be obtained. In addition, since the gap member is no longer required by employing the gapless structure, the number of components and the number of steps can be reduced. Stated another way, when the reactor of the present invention includes the hybrid core in which the relative magnetic permeability of the entire magnetic core is adjusted by making the magnetic permeability different in parts of the magnetic core, the gapless structure can be realized.

In one form of the reactor of the present invention, end surfaces of the inner core portion are flush respectively with end surfaces of the coil. Alternatively, one of the end surfaces of the inner core portion is flush with one of the end surfaces of the coil and the other end surface of the inner core portion projects from the other end surface of the coil. Alternatively, the end surfaces of the inner core portion project respectively from the end surfaces of the coil.

According to the above-described form, the inner core portion has a length equal to or larger than that of the coil in the axial direction thereof. Thus, since magnetic flux generated from the coil can be caused to sufficiently pass through the inner core portion formed of the powder compact that tends to have a higher saturation magnetic flux density than the mixture constituting the outer core portion, the above-described form can reduce the loss.

In one form of the reactor of the present invention, the end surface shape of the coil has a race track shape made up of a pair of semicircular arc portions and a pair of linear portions interconnecting the pair of semicircular arc portions, and at least the linear portion is contacted with the inner bottom surface of the case.

The end surface shape of the coil, which is non-circular and includes a curved portion, can be, e.g., (1) a shape made of substantially only a curved line, and (2) a shape having the curved portion and a linear portion.

An example of (1) the shape made of only a curved line is an ellipse. Since an elliptic coil has a shape close to a true circle and has a comparatively short circumferential length, the length of the wire constituting the coil can be easily shortened, and the amount of the wire used can be reduced. It is hence possible to reduce the loss, such as copper loss, and the weight.

Examples of (2) the shape having the curved portion and the linear portion include a corner-rounded polygonal shape in which corner portions of a polygon, including a tetragon such as a square or a rectangle, are rounded, and a special shape in which a part of the curved line in the above-mentioned ellipse is replaced with a linear line, as well as the above-mentioned race track shape. The presence of the linear portion is advantageous in that the linear portion can be easily contacted with the inner bottom surface of the case, which is typically formed as a flat surface, and that the contact state can be stably held. Accordingly, the coil including the linear portion can easily increase the contact area between the coil and the inner bottom surface of the case, and can efficiently transfer heat of the coil to the case through a contact region between them. Moreover, given that an area inside the coil is constant, the shape including the linear portion tends to have a shorter circumferential length than the shape made of only the linear line. Thus, as described above, it is possible to reduce the amount of the wire used, the loss, such as copper loss, and the weight.

In particular, the coil having the above-mentioned race track shape can be formed as an edgewise coil that is obtained by employing, as the wire, a rectangular wire including a conductor with a cross-sectional shape being quadrate (typically rectangular), and by winding the rectangular wire in an edgewise manner. Because an outer peripheral surface of the coil is formed as a surface defined by closely-arrayed side surfaces of individual turns of the rectangular wire, the edgewise coil can more easily ensure a larger contact area with respect to the case than a coil using a round wire. Furthermore, since the edgewise coil can be easily formed as a coil having a higher space factor, the coil having the race track shape can easily increase a space factor and reduce the size, thereby contributing to a size reduction of the reactor. When the coil having the race track shape is provided in a form where the length of the linear portion is increased and the distance between the pair of linear portions is reduced, i.e., in a form having a larger aspect ratio (major axis/minor axis), the contact region (at least the linear portion) between the coil and the inner bottom surface of the case is increased, thus resulting in a higher heat dissipation effect. In particular, that coil is preferably formed as a horizontally-long coil having the aspect ratio of about 1.1 to 2 from the viewpoint of increasing the contact area between the coil and the inner bottom surface of the case and reducing the height of the coil. The horizontally-long coil is further advantageous in that, since the entire coil is closer to the inner bottom surface of the case (i.e., the coil has a larger region where the distance to the inner bottom surface of the case is short) than a true-circular coil and the coil is positioned in its larger region close to the installation target, heat of the coil can be efficiently transferred to the inner bottom surface of the case and further to the installation target. In addition, since the coil having the race track shape includes the curved portion (semicircular arc portion) that tends to have a larger bend radius than the coil having the corner-rounded polygonal shape, it can be more easily formed as an edgewise coil. That point contributes to improving the productivity.

In one form of the reactor of the present invention, the reactor further comprises an inner resin portion made of an insulating resin and covering at least a part of a surface of the coil to hold a shape of the coil, the coil being contacted with the inner bottom surface of the case through the inner resin portion interposed therebetween.

The coil is typically formed by winding a wire that includes a conductor made of a conductive material, e.g., copper, and an insulating coating formed over an outer periphery of the conductor. When the coil is formed of the wire having the insulating coating, the insulating coating can electrically insulate between the coil and the magnetic core and between the coil and the case when the case is made of a metal material, e.g., aluminum. Furthermore, by covering at least a part of the coil (preferably the whole of regions of the coil where the coil contacts with the magnetic core and the case) with the insulating resin, it is possible to further enhance the insulation between the coil and the magnetic core and the insulation between the coil and the case. Moreover, according to the above-described form, since the shape of the coil is held by the inner resin portion, the coil can be avoided from deforming and expanding or contracting, for example, when the assembly of the coil and the inner core portion is arranged in the case during manufacturing of the reactor. As a result, the coil is easier to handle and the productivity of the reactor can be improved. In addition, the coil can be held in a compressed state by the inner resin portion. In that case, the length of the coil in the axial direction thereof can be shortened, whereby the size of the reactor can be reduced.

In one form of the reactor of the present invention, the inner bottom surface of the case includes a pedestal on which the coil is disposed, the pedestal including a coil groove formed following a part of the outer peripheral surface of the coil.

According to the above-described form, since the coil is disposed in the coil groove that has a shape following the outer peripheral surface of the coil, the contact area between the coil and the case can be increased, and the heat dissipation effect can be further enhanced. The coil groove can also be utilized for positioning of the coil. Thus, the above-described form further exhibits good assembly workability.

In one form of the reactor of the present invention, the coil is fixed to the case using an adhesive.

According to the above-described form, since adhesion between the coil and the case is increased, the heat dissipation effect can be further enhanced. Moreover, when the outer core portion is molded by filling the mixture of the magnetic powder and the unhardened resin into the case, a problem, for example, that the position of the coil may shift during a period until the resin is hardened, is less apt to occur. Thus, the above-described form further exhibits good productivity.

The reactor of the present invention can be suitably employed as a component of a converter. The converter of the present invention comprises a switching element, a drive circuit for controlling operation of the switching element, and a reactor for smoothing the switching operation, the converter converting an input voltage with the operation of the switching element, the reactor being the reactor of the present invention. The converter of the present invention can be suitably employed as a component of a power conversion device. The power conversion device of the present invention comprises a converter for converting an input voltage, and an inverter connected to the converter and inter-converting a direct current and an alternating current, the power conversion device driving a load with electric power converted by the inverter, the converter being the converter of the present invention.

The converter of the present invention and the power conversion device of the present invention have a good heat dissipation effect because of including the reactor of the present invention.

Advantageous Effects of Invention

The reactor of the present invention has a good heat dissipation effect. The converter of the present invention and the power conversion device of the present invention also have a good heat dissipation effect because they include the reactor of the present invention, which has a good heat dissipation effect.

DESCRIPTION OF EMBODIMENTS

Figure 1:
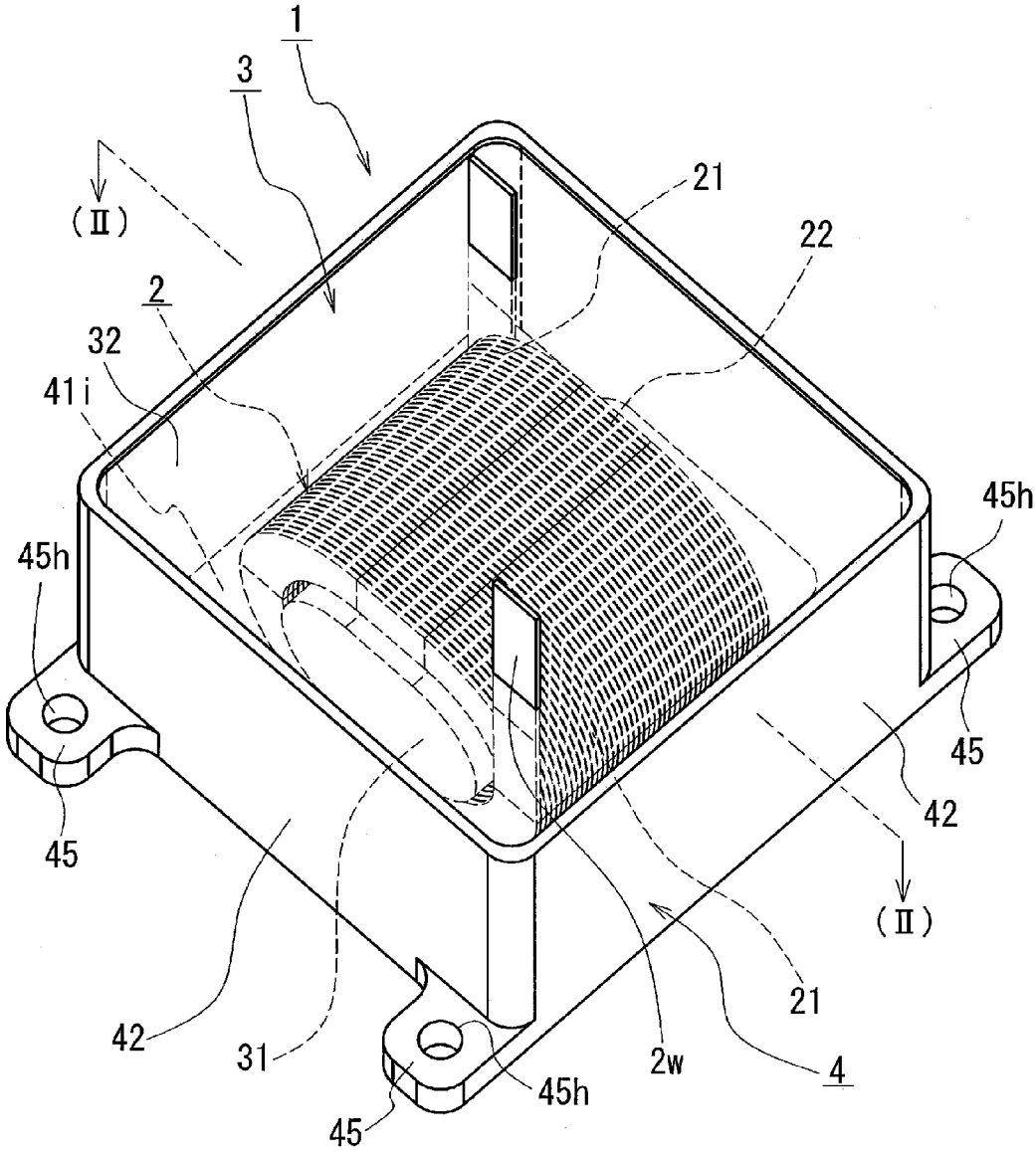
FIG. 1 is a schematic perspective view of a reactor according to Embodiment 1.

Embodiments of the present invention will be described in detail below with reference to the drawings. The same symbols in the drawings denote components called by the same names.

Embodiment 1

A reactor 1 of Embodiment 1 is described with reference to FIGS. 1 to 3. The reactor 1 includes one coil 2 formed by winding a wire 2*w*, a magnetic core 3 arranged inside and outside the coil 2 and forming a closed magnetic circuit, and a case 4 for housing an assembly of the coil 2 and the magnetic core 3. The reactor 1 is featured in an end surface shape of the coil 2, a housed state of the coil 2 with respect to the case 4, and a material of the magnetic core 3. The individual components will be described in detail below.

[Coil 2]

The coil 2 is a cylindrical member formed by spirally winding one continuous wire 2*w*. The wire 2*w* used here is preferably a coated wire including a conductor made of a conductive material, such as copper, aluminum or an alloy thereof, and an insulating coating made of an insulating material and formed over an outer periphery of the conductor. The conductor used here can be selected from conductors having various cross-sectional shapes, such as a rectangular wire having a rectangular cross-section, a round wire having a circular cross-section, and a special-form wire having a polygonal cross-section. The insulating material constituting the insulating coating is typically an enamel material, e.g., polyamide-imide. A thickness of the insulating coating is preferably 20 μm or more and 100 μm or less. The insulating coating having a larger thickness is more effective in reducing pin holes and enhancing insulation. The thickness of the insulating coating can be increased, for example, by forming the insulating coating with the enamel material coated in multiple layers. Furthermore, the insulating coating may have a multilayer structure made of different materials. In one example of the multilayer structure, a polyphenylene sulfide layer is formed on an outer periphery of a polyamide-imide layer. The insulating coating of the multilayer structure also provides superior electrical insulation. The number of windings (turns) can be selected as appropriate. The coil having the number of windings of about 30 to 70 can be preferably used as a vehicle-loaded part.

Here, the coil 2 is an edgewise coil (number of windings: 50) formed by edgewise-winding a coated rectangular wire in which a conductor is a rectangular wire (with an aspect ratio (width/thickness) of 5 or more and preferably 10 or more) made of copper and having a rectangular cross-section, and in which the insulating coating is made of enamel.

[End Surface Shape]

FIG. 2(A) is a sectional view of the reactor 1 when it is cut along a plane perpendicular to the axial direction of the coil 2. The coil 2 has a uniform sectional shape, which is the same as the shape of its end surface, when viewed in the axial direction thereof. As illustrated in FIG. 2(A), the end surface shape of the coil 2 is a shape including a curved portion and a linear portion. More specifically, the end surface of the coil 2 has a race track shape made up of a pair of linear portions 22 arranged in parallel, and a pair of semicircular arc portions 21 arranged to interconnect ends of the linear portions 22. Here, an aspect ratio (major axis/minor axis) of the coil 2 is set to about 1.3. Each semicircular arc portion 21 has a comparatively large bend radius, and it is a curved portion with moderate bending. Therefore, that end surface shape facilitates the edgewise winding of the wire. With that end surface shape, an outer peripheral surface and an inner peripheral surface of the coil 2 are made up of curved surfaces defined by the semicircular arc portions 21 and flat surfaces defined by the linear portions 22.

[Layout]

The coil 2 is housed in the case 4 in such a state that a part (inner core portion 31) of the magnetic core 3 is inserted inside the coil 2. In the reactor 1 of the present invention, particularly, the coil 2 is housed in the case 4 in a horizontal layout in which, when the reactor 1A is installed on an installation target such as a cooling base, the axial direction of the coil 2 is parallel to a surface of the installation target. In the reactor 1, because a flat outer bottom surface 41*o* of the case 4 serves as an installation surface that is contacted with the installation target, the coil 2 is housed in the case 4 in a state parallel to the outer bottom surface 41*o*. Of the outer peripheral surface of the coil 2, a flat surface region defined by the linear portion 22 is parallel to the outer bottom surface 41*o* of the case 4. In short, the coil 2 is housed in the case 4 to be horizontally long (FIG. 1).

A part of the outer peripheral surface of the coil 2 (here, the flat surface defined by one linear portion 22 and curved surfaces defined by zones of both the semicircular arc portions 21 connected to the one linear portion 22, the zones being positioned near points connected to the one linear portion 22) is covered with the magnetic core 3 (outer core portion 32). In short, a C-like shaped region of the outer peripheral surface of the coil 2, when perpendicularly looking at the end surface, is covered with the magnetic core 3. Furthermore, a remaining part of the outer peripheral surface of the coil 2, which part is not covered with the magnetic core 3, is contacted with an inner bottom surface 41*i* of the case 4. Here, the remaining part of the outer peripheral surface of the coil 2 is contacted with a coil groove 44 provided in the inner bottom surface 41*i* of the case 4. The coil groove 44 is formed in a pedestal 43 that is formed integrally in the inner bottom surface 41*i*.

[Treatment of End Portions]

The wire 2*w* forming the coil 2 has lead-out portions extending from the turn forming portion of the coil 2 over appropriate lengths and being led out to the outside of the outer core portion 32. Terminal members (not illustrated) made of a conductive material, e.g., copper or aluminum, are each connected to the conductor of the wire 2*w*, which is exposed by peeling off the insulating coating in each of both end portions of the wire 2*w*. An external device (not illustrated), such as a power supply for supplying electric power to the coil 2, is connected to the coil 2 through the terminal members. Welding, such as Tungsten Inert Gas (TIG) welding, pressure-bonding, etc. can be employed to connect the conductor of the wire 2*w* and each terminal member. In an example illustrated in FIG. 1, both the end portions of the wire 2*w* are led out perpendicularly to the axial direction of the coil 2, but the leading-out direction of both the end portions can be selected as appropriate. For example, both the end portions of the wire 2*w* may be led out parallel to the axial direction of the coil 2, or may be led out in different directions.

Of the lead-out portions, regions possibly contacted with at least the magnetic core 3 (particularly the outer core portion 32) are preferably each covered by arranging an insulating material, such as insulating paper, an insulating tape (e.g., a polyimide tape), or an insulating film (e.g., a polyimide film), or by dip-coating an insulating material, or by fitting an insulating tube (e.g., a heat-shrinkable tube or a room-temperature shrinkable tube). For example, when a voltage is applied to the coil having 50 turns as the number of windings, a voltage of about 600 V to 700 V may be applied to the lead-out portions even with a voltage between turns being about 12 V to 14 V. In view of such a point, insulation between the lead-out portions and the outer core portion 32 can be ensured by covering at least the regions of the lead-out portions, which are contacted with the magnetic core 3, with the insulating material.

[Magnetic Core 3]

As illustrated in FIG. 1, the magnetic core 3 includes the inner core portion 31 having a columnar shape and inserted within the coil 2, and the outer core portion 32 formed to cover at least one end surface of the inner core portion 31 and the part of the outer cylindrical peripheral surface of the coil 2. The magnetic core 3 forms a closed magnetic circuit when the coil 2 is excited. A material constituting the inner core portion 31 and a material constituting the outer core portion 32 are different from each other, and the magnetic core 3 has different magnetic characteristics in the respective portions. More specifically, the inner core portion 31 has a higher saturation magnetic flux density than the outer core portion 32, and the outer core portion 32 has a lower magnetic permeability than the inner core portion 31.

<<Inner Core Portion>>

The inner core portion 31 is a columnar member having a race track-like outer shape following the inner peripheral shape of the coil 2. While the inner core portion 31 is here a solid member entirely formed of a powder compact without including a gap member or an air gap, it may have a form including a gap member made of a nonmagnetic material, e.g., an aluminum plate, or an air gap.

The powder compact is typically obtained by compacting soft magnetic powder having an insulating coating made of, e.g., a silicone resin on a surface thereof, or a powder mixture of the soft magnetic powder and a binder added to and mixed with the former as appropriate, and then firing the compacted powder at a temperature lower than the heat resistant temperature of the insulating coating. When fabricating the powder compact, its saturation magnetic flux density can be changed by selecting the material of the soft magnetic powder, by adjusting a mixing ratio between the soft magnetic powder and the binder, amounts of various types of coatings including the insulating coating, etc., or by controlling compacting pressure. The powder compact having a higher saturation magnetic flux density can be obtained, for example, by employing the soft magnetic powder having a higher saturation magnetic flux density, by reducing an amount of the mixed binder to increase a proportion of the soft magnetic material, or by raising the compacting pressure.

Examples of the soft magnetic powder include powders made of iron-based materials, e.g., iron-group metals such as Fe, Co, Ni, etc., and Fe-based alloy materials containing Fe as a main ingredient, such as Fe—Si, Fe—Ni, Fe—Al, Fe—Co, Fe—Cr, Fe—Si—Al, etc., rare-earth metal powders, and ferrite powder. In particular, the Fe-based materials can more easily provide a magnetic core having a higher saturation magnetic flux density than the case using ferrite. The insulating coating formed on the soft magnetic powder can be made of, e.g., a phosphate compound, a silicon compound, a zirconium compound, an aluminum compound, or a boron compound. The insulating coating made of such a compound can effectively reduce the eddy current loss particularly when a magnetic particle constituting the magnetic powder is made of a metal, e.g., an iron group metal or a Fe-based alloy. The binder can be made of, e.g., a thermoplastic resin, a non-thermoplastic resin, or a higher fatty acid. The binder disappears or changes to an insulator, e.g., silica, with the above-mentioned firing. In the powder compact, because an insulator, e.g., the insulating coating, exists between magnetic particles, the magnetic particles are insulated from each other and the eddy current loss can be reduced. Accordingly, even when high-frequency power is supplied to the coil, the eddy current loss can be held small. The powder compact may be prepared by utilizing suitable one of known products.

Here, the inner core portion 31 is constituted by a powder compact that is made of the soft magnetic material having a coating, e.g., an insulating coating, and it has the saturation magnetic flux density of 1.6 T or more and 1.2 or more times the saturation magnetic flux density of the outer core portion 32. Furthermore, the relative magnetic permeability of the inner core portion 31 is 100 to 500, and the relative magnetic permeability of the entire magnetic core 3, made up of the inner core portion 31 and the outer core portion 32, is 10 to 100. When a certain amount of magnetic flux is to be obtained, a sectional area of the inner core portion can be further reduced as an absolute value of the saturation magnetic flux density of the inner core portion is higher and as the saturation magnetic flux density of the inner core portion is higher to a larger extent than that of the outer core portion. Therefore, a form in which the inner core portion has a higher saturation magnetic flux density can contribute to reducing the size of the reactor. The saturation magnetic flux density of the inner core portion 31 is preferably 1.8 T or more and more preferably 2 T or more, and it is preferably 1.5 or more times and more preferably 1.8 or more times the saturation magnetic flux density of the outer core portion 32. In any case, an upper limit is not specified. The saturation magnetic flux density of the inner core portion can be more easily increased by employing a stack of electric steel sheets, which are typically represented by silicon steel sheets, instead of the power compact.

In the example illustrated in FIG. 1, a length of the inner core portion 31 in the axial direction of the coil 2 (referred to simply as a length hereinafter) is longer than that of the coil 2. Both the end surfaces of the inner core portion 31 and the vicinities thereof slightly project respectively from corresponding end surfaces of the coil 2 in the state where the inner core portion 31 is inserted within the coil 2. A length by which the inner core portion 31 projects from the coil 2 can be optionally selected. While lengths by which the inner core portion 31 projects from both the ends of the coil 2 are the same here, the projection lengths may be different from each other. Furthermore, the inner core portion may be arranged such that the inner core portion projects from only one end surface of the coil 2. In another form, the length of the inner core portion may be equal to that of the coil, or the length of the inner core portion may be shorter than that of the coil. When the length of the inner core portion is equal to or larger than that of the coil, the loss can be reduced by arranging the inner core portion in a form where the end surfaces of the inner core portion project respectively from the corresponding end surfaces of the coil as in the illustrated example, or a form where the end surfaces of the inner core portion are respectively flush with the corresponding end surfaces of the coil, or a form where one end surface of the inner core portion is flush with one end surfaces of the coil and the other end surface of the inner core portion projects from the other end surface of the coil. In any of the above-mentioned forms, the outer core portion 32 is preferably disposed such that a closed magnetic circuit is formed when the coil 2 is excited.

Since the reactor 1 of the present invention is constructed in the horizontal layout as described above, the inner core portion 31 is also arranged to be horizontally long in accordance with the layout of the coil 2 when the reactor 1 is fixed to the installation target.

To enhance the insulation between the coil 2 and the inner core portion 31, an insulating member 33 (FIG. 2) is interposed between the inner core portion 31 and the coil 2. The insulating member 33 can be interposed, for example, by affixing an insulating tape to or by arranging insulating paper or an insulating sheet over the inner peripheral surface of the coil 2 or the outer peripheral surface of the inner core portion 31. Alternatively, a bobbin (not illustrated) made of an insulating material may be disposed around the inner core portion 31. The bobbin may be practiced, for example, in a form of a tubular member covering the outer periphery of the inner core portion 31, or a form including such a tubular member and flanges (typically, annular flanges) provided at both ends of the tubular member. An insulating resin, such as a polyphenylene sulfide (PPS) resin, a liquid crystal polymer (LCP), or a polytetrafluoroethylene (PTFE) resin, can be preferably used as a material of the bobbin. Additionally, when the bobbin is formed as a tubular member in combination of split pieces, it is easier to arrange the bobbin around the inner core portion 31.

<<Outer Core Portion>>

The outer core portion 32 is formed to cover not only substantially entire, regions of both the end surfaces and the outer peripheral surface of the coil 2, which regions are not contacted with the coil groove 44 of the case 4, but also both the end surfaces of the inner core portion 31 and the vicinities thereof. The outer core portion 32 has sectional shapes as follows. In a region of the reactor 1 where the coil 2 is present, when looking at a longitudinal section (i.e., a section cut along a plane extending in the axial direction of the coil 2 and being perpendicular to the outer bottom surface 41*o* (FIG. 2) of the case 4) and looking at a transverse section (i.e., a section cut along a plane perpendicular to the axial direction of the coil 2) as illustrated in FIG. 2(A), each of those sections has a C-like shape. Furthermore, when looking at a horizontal section (i.e., a section cut along a plane passing the axis of the coil 2 and being parallel to the outer bottom surface 41*o* of the case 4), that section has a rectangular frame shape. Parts of the outer core portion 32 are disposed so as to couple both the end surfaces 31*e* of the inner core portion 31 with each other, whereby the magnetic core 3 forms a closed magnetic circuit.

Here, the outer core portion 32 is entirely formed of a mixture (molded and hardened body) containing magnetic powder and resin. The inner core portion 31 and the outer core portion 32*h* are bonded to each other by the resin of the outer core portion 32 without an adhesive interposed therebetween. Here, the outer core portion 32 also has a form including neither a gap member nor an air gap. Accordingly, the magnetic core 3 is a one-piece member that is entirely integrated without including any gap member.

Since the outer core portion 32 covers substantially the entire region of the coil 2, which region is not contacted with the coil groove 44 of the case 4, in a manner of sealing off the coil 2 and the inner core portion 31 within the case 4, the outer core portion 32 also functions as a sealing member for the coil 2 and the inner core portion 31. In the reactor 1, therefore, the outer core portion 32 can protect the coil 2 and the inner core portion 31 from external environments and can enhance mechanical protection.

The outer core portion 32 is just required to form a closed magnetic circuit, and its shape (i.e., a region covering the coil 2) is a matter of choice. For example, the outer core portion 32 may have a form not covering a part of the outer periphery of the coil 2. In one example of such a form, a region of the outer peripheral surface of the coil 2 on the opening side of the case 4 is exposed without being covered with the outer core portion. In another case, a thickness of the pedestal 43 formed in a region of the case 4 on the bottom surface side is increased to provide a coil groove deeper than the coil groove 44 illustrated in FIG. 3. The deeper coil groove is formed, for example, to be contacted with not only the linear portion 22 of the coil 2, but also with larger regions of the semicircular arc portions 21 (e.g., ¼ circular arcs positioned on the bottom surface side of the case 4). The above-mentioned deeper coil groove may be provided by thickening the entire region of the case 4. Such a modification provides a form where a contact portion of the coil 2 with respect to the deeper coil groove is not covered with the outer core portion (i.e., a form where a contact area between the coil and the coil groove formed in the case is increased). However, the coil groove is preferably formed such that the end surfaces of the inner core portion 31 are exposed without being deeply buried in the coil groove and is sufficiently contacted with the outer core portion 32. In still another form, a poisoning member (not illustrated) for the coil 2 is separately disposed on the inner bottom surface 41*i* of the case 4, and a portion of the coil 2 contacting with the positioning member is not covered with the outer core portion. Heat dissipation can be enhanced by using a material having a good heat dissipation effect to form the positioning member.

The molded and hardened body can be typically formed by injection molding or cast molding. The injection molding is usually performed by mixing powder made of a magnetic material and resin in a fluidal state with each other, pouring the mixed fluid into a mold (here, the case 4) for molding under a predetermined pressure, and then hardening the resin. The cast molding is performed by preparing a mixed fluid similar to that used in the injection molding, pouring the mixed fluid into a mold for molding without application of pressure, and then hardening it.

The magnetic powder used in any of the molding methods may be powder similar to the soft magnetic powder used for the inner core portion 31 described above. In particular, the powder made of the iron-based material, e.g., the pure iron powder or the Fe-based alloy powder, can be preferably used as the soft magnetic power for the outer core portion 32. Plural types of magnetic powders made of different materials may also be used by mixing them. Coated powder can also be used in which an insulating coating made of, e.g., phosphate, is formed on the surface of a magnetic particle made of the soft magnetic material (particularly the metal material). The eddy current loss can be reduced by employing the coated powder. A mean particle diameter of the magnetic powder is preferably 1 μm or more and 1000 μm or less and more preferably 10 μm or more and 500 μm or less for convenience in use. It becomes easier to obtain a reactor having a higher saturation magnetic flux density and a smaller loss by employing plural types of powders having different particle diameters.

In any of the above-described molding methods, a thermosetting resin, such as an epoxy resin, a phenol resin, a silicone resin, or a urethane resin, can be preferably used as the resin serving as a binder. When the thermosetting resin is used, the resin is thermally hardened by heating a molded body. A room-temperature setting resin or a cold setting resin may be used as the resin serving as a binder. In that case, the resin is hardened by leaving a molded body to stand in a state of from a room temperature to a comparatively low temperature. Because the resin, which is a nonmagnetic material, remains in a comparatively large amount within the molded and hardened body, a core having a lower saturation magnetic flux density and a lower magnetic permeability can be more easily formed using the molded and hardened body in comparison with the case using the powder compact even when the same soft magnetic powder as that used for the powder compact constituting the inner core portion 31 is used.

In addition to the magnetic powder and the resin serving as a binder, filler made of ceramic, e.g., alumina or silica, may be further mixed into the materials of the molded and hardened body. By mixing the filler having a smaller specific gravity than the magnetic powder, it is possible to suppress localized presence of the magnetic powder, and to more easily obtain the outer core portion over the entirety of which the magnetic powder is uniformly dispersed. Furthermore, when the filler is made of a material having good thermal conductivity, the filler contributes to improving the heat dissipation effect. When the filler is mixed, the content of the filler is, for example, 0.3% or more by mass and 30% or less by mass with respect to 100% by mass of the molded and hardened body. The total content of the magnetic powder and the filler is, for example, 20% by volume to 70% by volume with respect to 100% by volume of the outer core portion. Moreover, using the filler in a finer particle than the magnetic powder is advantageous in that the filler is interposed between the magnetic particles in a way capable of effectively preventing localized presence of the magnetic powder and uniformly dispersing the magnetic powder, and that a reduction of a proportion of the magnetic powder due to addition of the filler can be suppressed with ease.

When the coil 2 is arranged in the horizontal layout as in the reactor 1 and the coil 2 is housed in the case 4 in a state positioned close to the inner bottom surface 41*i* of the case 4, the magnetic powder may precipitate onto a bottom wall 41 of the case 4 during the production of the molded and hardened body, thus resulting in the outer core portion in which the magnetic powder is localized on the side near the boom wall 41. Even in that case, however, because the inner core portion 31 is positioned close to the bottom wall 41 of the case 4 and the outer core portion tends to come into a such state that a region of the outer core portion where the magnetic powder is present at a high density is contacted with the inner core portion 31, a closed magnetic path can be sufficiently formed.

Here, the outer core portion 32 is formed of the molded and hardened body containing the coated powder, which has the insulating coating on the surface of a magnetic particle made of the iron-based material and having a mean particle diameter of 100 μm or less, and an epoxy resin. The outer core portion 32 has the relative magnetic permeability of 5 to 30 and the saturation magnetic flux density of 0.5 T or more and less than that of the inner core portion 31. By setting the magnetic permeability of the outer core portion 32 to be lower than that of the inner core portion 31, it is possible to reduce leakage flux of the magnetic core 3, and to constitute the magnetic core 3 of a gapless structure. The magnetic permeability and the saturation magnetic flux density of the molded and hardened body can be adjusted by changing a mixing ratio of the magnetic powder and the resin serving as a binder. For example, the molded and hardened body having a lower magnetic permeability is obtained by reducing an amount of the magnetic powder mixed. The saturation magnetic flux density and the relative magnetic permeability of each of the core portions 31 and 32 can be measured by preparing a specimen obtained from each of the core portions 31 and 32, and by employing, e.g., a commercially-available B-H curve tracer or a Vibrating Sample Magnetometer (VSM).

[Case]

Figure 2:
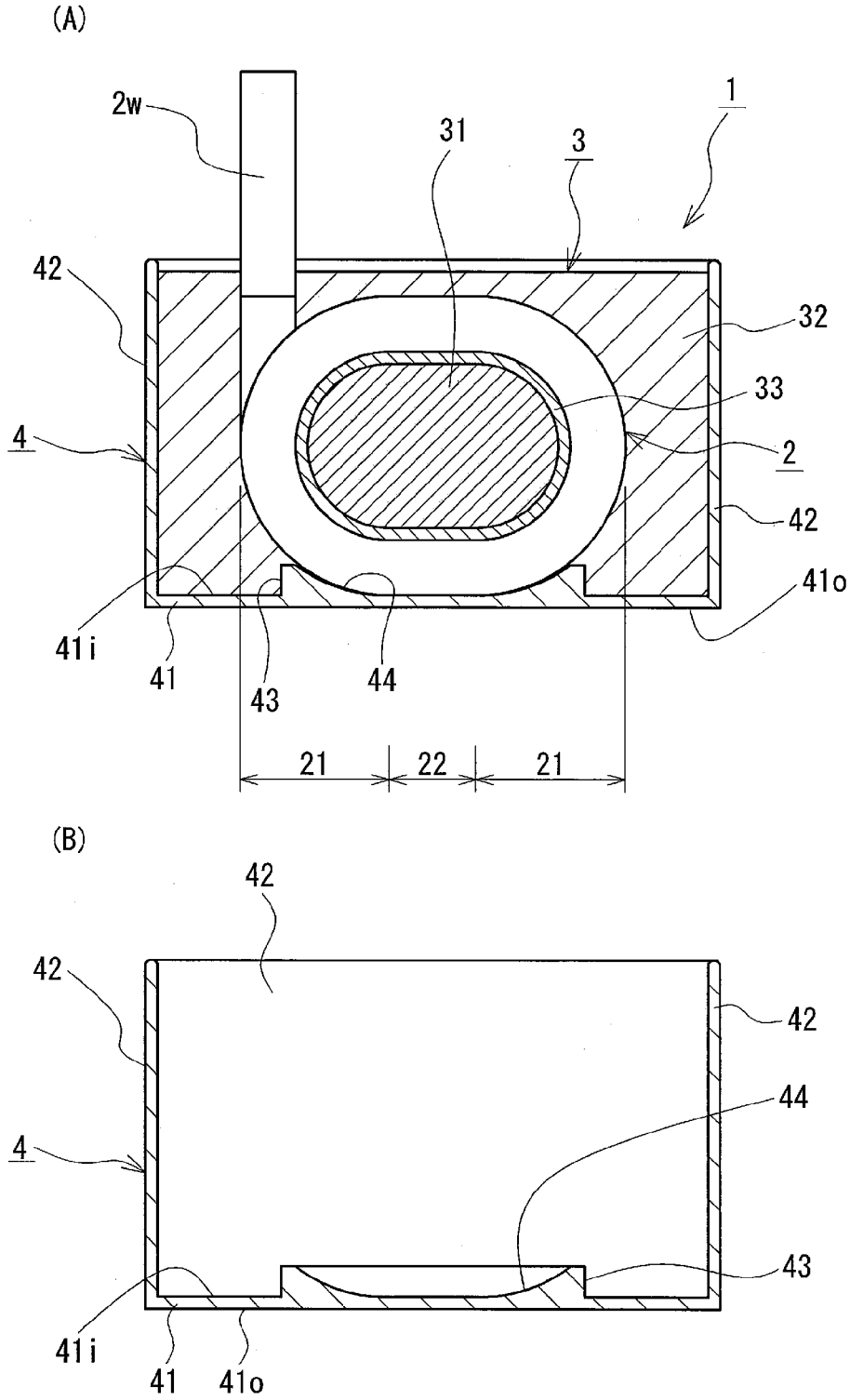
FIG. 2(A) is a sectional view, taken along a line (II)-(II) in FIG. 1, of the reactor according to Embodiment 1.
FIG. 2(B) is a sectional view illustrating only a case that is included in the reactor illustrated in FIG. 2(A).
Figure 3:
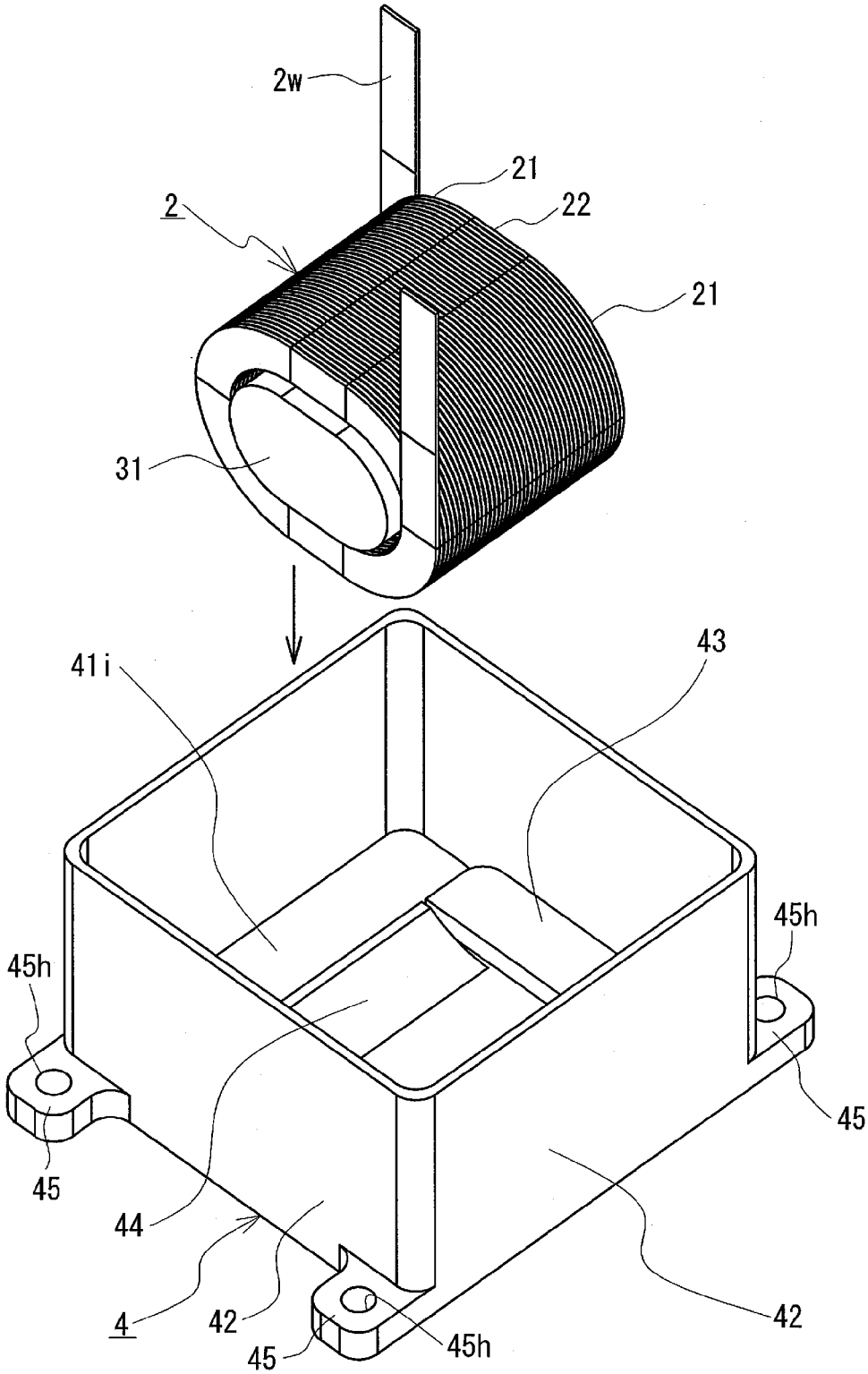
FIG. 3 is a schematic exploded view to explain constituent members of the reactor according to Embodiment 1.

The case 4 is typically, as illustrated in FIGS. 1 to 3, a rectangular parallelepiped box-like member constituted by a rectangular bottom wall 41 and four sidewalls 42 vertically extending from the bottom wall 41 with a surface opposed to the bottom wall 41 being open. The case 4 is typically utilized as not only a container for housing the assembly of the coil 2 and the magnetic core 3, but also as a heat dissipation path. Accordingly, the case 4 is suitably made of a material having good thermal conductivity, preferably a material, e.g., a metal such as aluminum, an aluminum alloy, magnesium, or a magnesium alloy, having a higher thermal conductivity than the magnetic power made of iron, for example. Because aluminum, magnesium, and alloys of the formers are light-weight, they are suitable as materials of automobile parts for which weight lightening is demanded. In addition, because aluminum, magnesium, and alloys of the formers are nonmagnetic materials and conductive materials, leakage flux to the outside of the case 4 can also be effectively prevented. Here, the case 4 is made of an aluminum alloy.

While an outer peripheral shape and an inner peripheral shape of the case 4 are typically analogous to each other, they are non-analogous in the case 4 used here. In more detail, as illustrated in FIG. 2(B), the bottom wall 41 of the case 4 has the outer bottom surface 41*o* that serves as the installation surface when the reactor 1 is installed on the installation target such as a water cooling base. The outer bottom surface 41*o* functions as a cooling surface cooled by the installation target. The outer bottom surface 41*o* is formed as a flat surface. The bottom wall 41 further has the inner bottom surface 41*i* with which the part of the outer peripheral surface of the coil 2 is contacted. As illustrated in FIG. 2(B), the inner bottom surface 41*i* has an uneven shape with a thickness varying in parts. The inner bottom surface 41*i* includes a pedestal 43 formed in its central portion and extending from one sidewall 42 to the other sidewall 42 opposed to the former, and the bottom wall 41 is thickened in its portion corresponding to the pedestal 43. Here, the pedestal 43 is formed integrally with the inner bottom surface 41*i*. The coil groove 44 is formed in a part of the pedestal 43 for fitting with the part of the outer peripheral surface of the coil 2.

As illustrated in FIG. 3, the coil groove 44 has a shape following the outer peripheral surface of the coil 2, and it is made up of a flat surface portion that is contacted with the flat surface region of the coil 2 extending along the flat surface defined by the linear portion 22, and curved portions that are contacted with the curved surface regions of the coil 2 extending along the curved surfaces defined by the semicircular arc portions 21. A region of the pedestal 43 constituting the flat portion thereof has a minimum thickness that is comparable to the thickness of the bottom wall 41 (FIG. 2) in its region where the pedestal 43 is not present. By thus thickening only a part of the bottom wall 41, it is possible to ensure a sufficient volume of the outer core portion 32 (FIGS. 1 and 2) and to suppress an increase in weight of the case 4. Moreover, since the coil groove 44 has the shape following the outer peripheral surface of the coil 2, the coil groove 44 can also function as a member for positioning the coil 2 relative to the case 4.

A thick portion of the pedestal 43 where the coil groove 44 is not formed can function as a support for the inner core portion 31. The support is not necessarily required to have a large area as illustrated in FIG. 3 if it can support the inner core portion 31. Thus, the support may be formed in a smaller area than that illustrated in FIG. 3 (i.e., in a shorter length in the axial direction of the coil and/or in a shorter length in a direction perpendicular to the axial direction of the coil). Alternatively, the pedestal 43 may have a form including only the coil groove 44 contacted with the outer peripheral surface of the coil 2 such that the end surfaces of the coil 2 and the end surfaces of the inner core portion 31 are not covered. The volume of the outer core portion 32 can be increased by reducing the volume of the pedestal 43.

In an alternate form, the inner bottom surface 41*i* may be formed as a flat surface with omission of the coil groove 44. Even in that case, since the coil 2 has the linear portion 22, the flat surface region of the outer peripheral surface of the coil 2, defined by the linear portion 22, can be held in contact with the flat inner bottom surface of the case. When the coil groove 44 is not formed, a positioning member (not illustrated) may be separately disposed for easier positioning of the coil 2 within the case 4. The positioning member is preferably formed, for example, as a molded and hardened body made of a material similar to that of the outer core portion 32. The reason is that such a molded and hardened body can be easily integrated with the outer core portion 32 when the outer core portion 32 is formed, and that the separate positioning member can be utilized as a magnetic circuit. Alternatively, heat dissipation can be enhanced by employing a material having a good heat dissipation effect to form the positioning member. Moreover, when the outer bottom surface 41*o* (FIG. 2) is constituted by substantially only a flat surface as in this embodiment, a large contact area with respect to the installation target can be sufficiently ensured and the productivity of the case 4 can be improved. However, the outer bottom surface may have an uneven portion for the purpose of, e.g., increasing a surface area of the case 4.

In addition, in the example illustrated in FIG. 1, the case 4 includes mounting portions 45 having bolt holes 45*h* to fix the reactor 1 to the installation target using fixing members, e.g., bolts. With the provision of the mounting portions 45, the reactor 1 can be easily fixed to the installation target using fixing members, e.g., bolts. The case 4 including the pedestal 43, the coil groove 44, and the mounting portions 45 as described above and having a complicated three-dimensional shape can be easily manufactured by casting or cutting, for example.

While the case 4 may be used in an open state, it is preferably used in a form including a cover that is made of a conductive material, e.g., aluminum, like the case 4 from the viewpoint of preventing the leakage flux and protecting the outer core portion 32 from environments and mechanical damages. Cutouts or through-holes are formed in the cover such that the end portions of the wire 2*w* of the coil 2 can be led out through the cover.

In order to enhance the insulation between the coil 2 and the case 4, an insulating member, e.g., insulating paper, an insulating sheet, or an insulating tape, may be interposed between them. The insulating member can be disposed, for example, by winding the insulating tape, etc. over the surface of the coil 2 such that the insulating member covers both the inner peripheral surface and the outer peripheral surface of the coil 2 (including the end surfaces of the coil 2 in some cases). In an alternative form, the insulating member 33 may be disposed over the inner periphery of the coil 2 as described above, and the above-mentioned insulating member may be separately disposed between the inner bottom surface 41*i* of the case 4 and a region of the coil 2 where the coil 2 is contacted with the inner bottom surface 41*i*. That insulating member is required to have a thickness just enough to ensure the insulation at a minimum level necessary between the coil 2 and the case 4. By minimizing the thickness of the insulating member, it is possible to suppress a reduction of thermal conductivity caused by the presence of the insulating member, and to reduce the size. The insulating member used here preferably has a high thermal conductivity.

Alternatively, an insulating adhesive may be used as the above-mentioned insulating member. Stated another way, the coil 2 and the case 4 may be fixed to each other using an adhesive. In that case, the insulating adhesive can not only enhance the insulation between the coil 2 and the case 4, but also fix the coil 2 to the case 4 in close contact by the action of an adhesive regardless of a resin component contained in the outer core portion 32. The insulating adhesive is preferably made of an adhesive that contains filler particularly having good thermal conductivity, e.g., filler made of alumina having good thermal conductivity and good electrical insulation. By forming a layer of the insulating adhesive in a smaller thickness and in a multilayer structure, electrical insulation can be enhanced even with a smaller total thickness of the insulating adhesive. Good workability can be obtained by employing the insulating adhesive in the form of a sheet. The insulating adhesive may be one of commercially available adhesives.

In the present invention, even when, between the coil 2 and the case 4, an insulating member providing insulation at a level required for electrical insulation therebetween is interposed, such an arrangement is regarded as falling within the form where the coil and the inner bottom surface of the case are contacted with each other. By minimizing the thickness of the insulating member, a reduction of thermal conductivity caused by the presence of the insulating member can be suppressed. For example, the thickness of the insulating member (total thickness in the case of a multilayer structure) may be less than 2 mm, or 1 mm or less, or especially 0.5 mm or less

[Intended Use]

The reactor 1 having the above-described structure can be suitably used under energization conditions with, e.g., a maximum current (direct current) of about 100 A to 1000 A, an average voltage of about 100 V to 1000 V, and working frequency of 5 kHz to 100 kHz, typically as a component of a vehicle-loaded power conversion device for an electric car or a hybrid car. In such use, the reactor 1 is expected to be suitably used with satisfaction of the conditions that an inductance is 10 μH or more and 2 mH or less when the supplied direct current is 0 A, and that an inductance during supply of a maximum current is 10% or more of the inductance obtained at 0 A.

[Size of Reactor]

When the reactor 1 is used as a vehicle-loaded component, the capacity of the reactor 1, including the case 4, is preferably about 0.2 liter (200 $cm^3$) to 0.8 liter (800 $cm^3$). In this embodiment, the capacity is about 500 $cm^3$.

[Method of Manufacturing Reactor]

The reactor 1 can be manufactured, by way of example, as follows. First, the coil 2 and the inner core portion 31 formed of the power compact are prepared. The inner core portion 31 is inserted into the coil 2 to fabricate the assembly of the coil 2 and the inner core portion 31, as illustrated in FIG. 3. As described above, the insulating member 33 may be disposed between the coil 2 and the inner core portion 31, as required (the insulating member 33 is omitted in FIG. 3). Furthermore, insulating members, e.g., insulating tubes may be fitted over the lead-out portions of the wire 2*w*, as described above.

Next, the above-mentioned assembly is placed into the case 4. By fitting the coil 2 of the assembly to the coil groove 44, the assembly can be properly positioned inside the case 4 with ease. The mixed fluid of the magnetic powder and the resin, the mixed fluid constituting the outer core portion 32 (FIG. 1), is poured into the case 4 as appropriate for molding into a predetermined shape, and the resin is then hardened. Thus, the outer core portion 32 can be formed and the reactor 1 (FIG. 1) can be obtained simultaneously.

Advantageous Effects

Since the reactor 1 is constructed such that the part of the outer peripheral surface of the coil 2 is contacted with the inner bottom surface 41*i* of the case 4, heat of the coil 2 can be directly transferred to the case 4 made of, e.g., aluminum and having good thermal conductivity and can be efficiently dissipated to the installation target, such as the water cooling base, through the outer bottom surface 41*o* (cooling surface) of the case 4. Accordingly, the reactor 1 has a good heat dissipation effect. In particular, the reactor 1 can improve the heat dissipation effect with such an arrangement that the end surface of the coil 2 has the race track shape including the curved portion and the linear portion, and that the flat region defined by the linear portion is utilized as a contact region with respect to the case 4, thus enabling the contact area between the coil 2 and the case 4 to be easily increased. Furthermore, since the linear portion 22 of the coil 2 is utilized as the region contacted with the case 4, the coil 2 is stably supported on the inner bottom surface 41*i* of the case 4, and such a supported state is reliably maintained because the coil 2 is sealed off by the outer core portion 32 while being held in that supported state. Therefore, the reactor 1 has the good heat dissipation effect for a long term. Moreover, with the reactor 1, since the coil groove 44 having a shape following the outer peripheral surface of the coil 2 is formed in the inner bottom surface 41*i* of the case 4 such that not only the linear portion 22, but also the parts of the curved regions defined by the semicircular arc portions 21 are contacted with the inner bottom surface 41*i*, the contact area between the coil 2 and the case 4 is increased and the heat dissipation effect is improved in comparison with the case where the inner bottom surface is formed by only a flat surface. In addition, since the outer periphery of the coil 2 is covered with the molded and hardened body containing the magnetic powder, the reactor 1 has a higher heat dissipation effect than when the outer periphery of the coil 2 is covered with only resin.

Since the reactor 1 includes one coil 2 and has the horizontal layout where the coil 2 is housed in the case 4 such that the axial direction of the coil 2 is parallel to the outer bottom surface 41*o* of the case 4, the reactor 1 has a lower height and a smaller size. In particular, with the reactor 1, since the end surface of the coil 2 has the race track shape, the coil 2 can be formed as an edgewise coil by employing a coated rectangular wire as the wire 2*w*, thus providing a coil with a higher space factor and a smaller size. That point also contributes to reducing the size of the reactor 1. Moreover, with the reactor 1, the case 4 can be utilized as a heat dissipation path, and the case 4 can protect the assembly of the coil 2 and the magnetic core 3 from external environments, such as dust and corrosion, and from mechanical damages.

With the reactor 1, since the outer core portion 32 is made of the mixture containing magnetic powder and resin, the outer core portion 32 having the desired shape can be easily fabricated. Accordingly, even when the reactor 1 has a complicated shape covering the part of the outer peripheral surface of the coil 2, good productivity is obtained with easier fabrication of the outer core portion 32. In addition, using the above-mentioned mixture can provide the following advantageous effects: (1) magnetic characteristics of the outer core portion 32 can be easily changed, and (2) since the outer core portion 32 contains the resin component, the coil 2 and the inner core portion 31 can be protected from external environments and mechanical damages even with the case 4 being in an open state.

With the reactor 1, since the inner core portion 31 is formed of the power compact, the inner core portion 31 having a complicated three-dimensional shape, i.e., a columnar member having an outer shape like a race track following the inner peripheral shape of the coil 2, can be easily formed, whereby good productivity is obtained. Furthermore, since the inner core portion 31 is formed of the powder compact, magnetic characteristics, including the saturation magnetic flux density, can be easily adjusted.

With the reactor 1, since the inner core portion 31 has a higher saturation magnetic flux density than the outer core portion 32, a sectional area of the inner core portion 31 (i.e., a surface thereof through which magnetic flux passes) can be reduced when the same magnetic flux is to be obtained with a magnetic core that is made of a single material and that has a uniform saturation magnetic flux density over the entire magnetic core. That point further contributes to reducing the reactor size. With the reactor 1, since the inner core portion 31 over which the coil 2 is arranged has a higher saturation magnetic flux density and the outer core portion 32 covering the part of the outer peripheral surface of the coil 2 has a lower magnetic permeability, magnetic saturation can be suppressed even with omission of a gap. The omission of the gap can further reduce the reactor size. With the reactor 1, since a gap for adjusting inductance is not present over the entire magnetic core 3, leakage flux through the gap does not affect the coil 2, thus enabling the outer peripheral surface of the inner core portion 31 and the inner peripheral surface of the coil 2 to be positioned closer to each other. Thus, a clearance between the outer peripheral surface of the inner core portion 31 and the inner peripheral surface of the coil 2 can be reduced, whereby the size of the reactor 1A can be further reduced. In particular, with the reactor 1, since the inner core portion 31 has the outer shape analogously following the inner peripheral surface of the coil 2, the above-mentioned clearance can be further reduced. Moreover, the loss attributable to the presence of the gap can be reduced with the omission of the gap.

With the reactor 1, at the same time as when the outer core portion 32 is formed, the inner core portion 31 and the outer core portion 32 are bonded to each other with the resin constituting the outer core portion 32, thereby forming the magnetic core 3. As a result, the reactor 1 can be manufactured. Therefore, the number of manufacturing steps is reduced and the productivity is improved. Moreover, since the reactor 1 has a gapless structure, a step of bonding a gap member is not needed. That point also contributes to improving the productivity.

Embodiment 2

Figure 4:
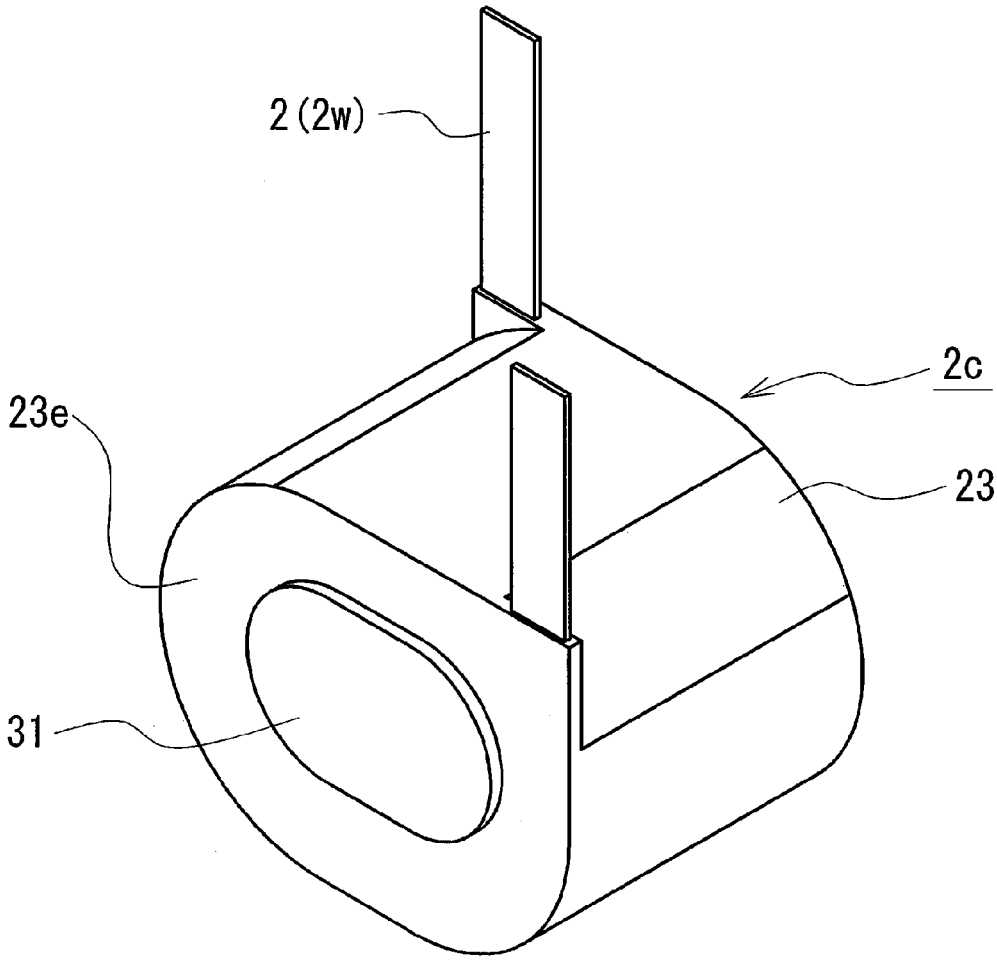
FIG. 4 is a schematic perspective view of a coil molded product included in a reactor according to Embodiment 2.

A reactor of Embodiment 2 will be described below with reference to FIG. 4. Embodiment 1 has been described in connection with the arrangement in which the insulation between the coil 2 and the magnetic core 3 and the insulation between the coil 2 and the case 4 are enhanced with the insulating coating of the wire 2*w* constituting the coil 2 and the separately-prepared insulating member 33. The reactor of Embodiment 2 differs from the reactor 1 of Embodiment 1 in including an inner resin portion 23 that covers the surface of the coil 2. The following description is made mainly about such a different point and advantageous effects based on the difference point, whereas description of construction and advantageous effects common to those in Embodiment 1 is omitted.

The reactor of Embodiment 2 includes a coil molded product 2*c* in which the coil 2 and the inner core portion 31 are integrated with each other by a resin constituting the inner resin portion 23.

[Coil Molded Product]

The coil molded product 2*c* includes the coil 2, described in Embodiment 1, in which the wire 2*w* is a coated rectangular wire and its end surface has the race track shape, the inner core portion 31 inserted inside the coil 2, and the inner resin portion 23 not only covering the surface of the coil 2 to hold the shape of the coil 2, but also holding the coil 2 and the inner core portion 31 integrally with each other.

<<Inner Core Portion>>

The inner core portion 31 is a columnar member having an outer shape like a race track, as in Embodiment 1 described above. The inner core portion 31 is inserted inside the coil 2 and is integrated with the coil 2 by the resin of the inner resin portion 23 in a state where both the end surfaces of the inner core portion 31 and the vicinities thereof slightly project respectively from corresponding end surfaces 23*e* of the inner resin portion 23.

<<Inner Resin Portion>>

Here, the inner resin portion 23 covers substantially the entirety of the coil 2 except for the lead-out portions of the wire 2*w* including both end portions thereof. A region of the coil 2, which is covered with the inner resin portion 23, can be optionally selected. For example, the coil 2 may be partly exposed without being covered with the inner resin portion 23. However, an insulator, e.g., the resin of the inner resin portion 23, can be caused to reliably exist between the coil 2 and the inner core portion 31, between the coil 2 and the outer core portion, and between the coil 2 and the case by covering substantially the entire surface of the coil 2 as in this embodiment. A thickness of the inner resin portion 23 is substantially uniform. The thickness of the inner resin portion 23 can be optionally selected so as to satisfy the desired insulation characteristic, and it is, for example, about 1 mm to 10 mm. The thinner the inner resin portion 23, the higher is the heat dissipation effect.

The inner resin portion 23 further has the function of holding the coil 2 in a state compressed from a free-length state.

The resin of the inner resin portion 23 can be preferably made of an insulating material, which has heat resistance at such an level that the insulating material is not softened at a maximum reachable temperature of the coil 2 and the magnetic core during use of the reactor including the coil molded product 2*c*, and which can be molded by transfer molding or injection molding. For example, thermosetting resins, such as epoxy, and thermoplastic resins, such as a PPS resin and an LCP, can be preferably used. Here, an epoxy resin is used. Furthermore, a reactor being able to more easily dissipate heat of the coil 2 and having a higher heat dissipation effect can be obtained by employing, as the resin of the inner resin portion 23, a resin mixed with filler that is made of at least one type of ceramics selected from silicon nitride, alumina, aluminum nitride, boron nitride, and silicon carbide.

[Method of Manufacturing Coil Molded Product]

The above-described coil molded product 2*c* including the inner core portion 31 can be manufactured, for example, by employing a manufacturing method described in Japanese Unexamined Patent Application Publication No. 2009-218293. In more detail, a mold capable of opening and closing and including a plurality of rod-like members, which are movable back and forth inside the mold, is prepared. After arranging the coil 2 and the inner core portion 31 within the mold, the coil 2 is pressed by the rod-like members into a compressed state. In the compressed state, the resin is poured into the mold and then solidified.

Alternatively, a holding member capable of holding the coil in a compressed state may be separately prepared and, after attaching the holding member to the coil and placing the coil in the compressed state into a mold, the holding member may be fixed to the mold, to thereby hold the coil in the compressed state within the mold. The holding member is preferably constituted to be removable for reuse.

In the coil 2, as described above, an insulating member, e.g., insulating paper, an insulating tape, or an insulating tube, can be arranged as appropriate over a region (near the end of the wire 2*w*) of each of the lead-out portions of the wire 2*w*, which region is not covered with the inner resin portion 23 and is possibly contacted with the outer core portion. When the insulating member is arranged over each of the lead-out portions of the coil 2, the shape of the inner resin portion 23 can be simplified and moldability can be improved. Furthermore, the coil molded product can be more easily reduced in size, thus further contributing to a size reduction of the reactor, in comparison with the case where the lead-out portions are covered with the resin of the inner resin portion 23.

[Method of Manufacturing Reactor]

The reactor including the above-described coil molded product 2*c* can be manufactured by fabricating the coil molded product 2*c*, placing the coil molded product 2*c* in the case, pouring a mixed fluid of magnetic material and resin, the mixed fluid constituting the outer core portion, into the case for molding, and then hardening the resin. The coil molded product 2*c* may be fixed to the case using the above-described adhesive.

Advantageous Effects

With the reactor of Embodiment 2, since the surface of the coil 2 is covered with the inner resin portion 23, the coil 2 is contacted with the inner bottom surface of the case through the inner resin portion 23 interposed therebetween. Thus, because of an insulator being interposed between the coil 2 and the case, the insulation between the coil 2 and the case can be effectively enhanced even when the case is made of a metal, e.g., aluminum. Furthermore, in spite of the inner resin portion 23 being interposed between the coil 2 and the case, the reactor of Embodiment 2 has a good heat dissipation effect similarly to the reactor of Embodiment 1 because a larger region of the coil 2 is positioned close to the installation target with the arrangement that the end surface of the coil 2 has a particular shape, i.e., a race track shape, and that the reactor is arranged in the horizontal layout.

In the coil molded product 2*c*, the coil 2 and the inner core portion 31 are integrated with each other by the inner resin portion 23, and substantially only the resin of the inner resin portion 23 is present in a clearance between the inner peripheral surface of the coil 2 and the outer peripheral surface of the inner core portion 31. Therefore, the insulation between the coil 2 and the inner core portion 31 can also be effectively enhanced without using an additional member, e.g., an insulator. Moreover, since the reactor of Embodiment 2 employs the coil molded product 2*c* capable of holding the shape of the coil 2, the shape of the coil 2 is stable and the coil 2 is easier to handle during manufacturing, thus resulting in good productivity. In particular, since the coil molded product 2*c* includes the inner core portion 31 in an integral form, the coil 2 and the inner core portion 31 can be integrated with each other at the same as the molding of the inner resin portion 23, whereby the number of steps and the number of components can be reduced. That point also contributes to improving the productivity of the reactor. In addition, since the coil 2 and the inner core portion 31 can be handled as an integral unit and they can be simultaneously placed into the case, an operation of placing the coil 2 and the inner core portion 31 into the case becomes easier than when they are separately from each other. That point further contributes to improving the productivity of the reactor.

Furthermore, since the coil molded product 2*c* holds the coil 2 in the compressed state by the inner resin portion 23, the length of the coil 2 in the axial direction thereof can be shortened without using an additional member to maintain the coil 2 in the compressed state. That point contributes to the size reduction of the reactor. If the coil 2 and the inner core portion 31 are separate members without being integrated with each other by the inner resin portion 23, it is required to form a hollow hole in the inner resin portion for insertion of the inner core portion 31 and to provide a clearance between the inner core portion 31 and a wall of the hollow hole in consideration of easiness in inserting the inner core portion 31. In contrast, in this embodiment in which the coil 2 and the inner core portion 31 are integrated with each other by the inner resin portion 23, such a clearance is not required and the size of the reactor can be reduced corresponding to the absence of that clearance.

Embodiment 3

Embodiment 2 has been described in connection with the coil molded product 2*c* that is constructed by integrating the coil 2 and the inner core portion 31 with each other using the inner resin portion 23. In another form of the coil molded product, the inner core portion may be not integrated with the coil by the inner resin portion. In other words, the coil molded product may be made up of the coil and the inner resin portion. That coil molded product has a hollow hole that is defined by the resin of the inner resin portion covering the inner peripheral surface of the coil. The inner core portion is inserted into the hollow hole. The resin of the inner resin portion can be caused to function as a member for positioning the inner core portion by adjusting a thickness of the resin of the inner resin portion such that the inner core portion is arranged at an appropriate position inside the coil, and by forming a shape of the hollow hole in match with the outer shape of the inner core portion.

The above-described coil molded product can be manufactured by arranging a molding core with a predetermined shape, instead of the inner core portion, in the step of fabricating the coil molded product 2*c*, the step being described above in Embodiment 2. A reactor including the above-described coil molded product can be manufactured by inserting the inner core portion into the hollow hole of the coil molded product thus obtained, placing an assembly of the coil molded product and the inner core portion into the case, and then forming the outer core portion.

According to this embodiment, the coil is easier to handle because the inner resin portion maintains the shape of the coil as in the coil molded product 2*c* of Embodiment 2. Furthermore, this embodiment can also enhance the insulation between the coil and the magnetic core and the insulation between the coil and the case for the reason that the inner resin portion is interposed between the coil and the inner core portion, between the coil and the outer core portion, and the insulation between the coil and the case as in the coil molded product 2*c* of Embodiment 2.

Embodiment 4

While the foregoing embodiments have been described in connection with the case where the end surface of the coil has the race track shape, the end surface of the coil may have an elliptic shape, a special shape in which a part of a curved line of a horizontally-long ellipse is replaced with a linear line parallel to the major axis of the ellipse, thus including one linear portion, or a rectangular shape having rounded corners.

In the coil having an elliptic shape, it is particularly preferable that the coil has a horizontally-long elliptic shape with a large aspect ratio (major axis/minor axis) because a region of the coil close to the inner bottom surface of the case (and hence to the installation target) is increased, whereby the heat dissipation effect is improved. Furthermore, the horizontally-long coil has a lower height and a smaller size. Fabrication of that coil having a shape defined by only a curved line is facilitated, for example, by employing a round wire of which conductor has a circular cross-sectional shape. On condition that an area inside the coil is held constant, the elliptic coil has a shorter circumferential length than the coil 2 in the reactor 1 of Embodiment 1, which has the race track shape. It is hence possible to reduce an amount of the wire used to form the coil, the loss such as copper loss, and the weight.

Each of the coil having the special shape and the coil having the corner-rounded rectangular shape has a linear portion similarly to the coil 2 in the reactor 1 of Embodiment 1 having the race track shape. Accordingly, even when the inner bottom surface of the case is a flat surface, that type of coil can not only sufficiently provide an contact area with respect to the inner bottom surface of the case, but also exhibit good stability with respect to the case. Fabrication of the coil having the special shape is also facilitated by using the round wire. On the other hand, the coil having the corner-rounded rectangular shape can be formed as an edgewise coil using a rectangular wire similarly to the coil 2 in the reactor 1 of Embodiment 1. Thus, the contact area can be increased with the presence of the flat surface region defined by the linear portion, while a space factor can be increased and the coil size can be reduced.

Embodiment I

The reactors of Embodiments 1 to 4 can be each utilized, for example, as a component of a converter loaded on a vehicle, etc., or a component of a power conversion device including the converter.

Figure 5:
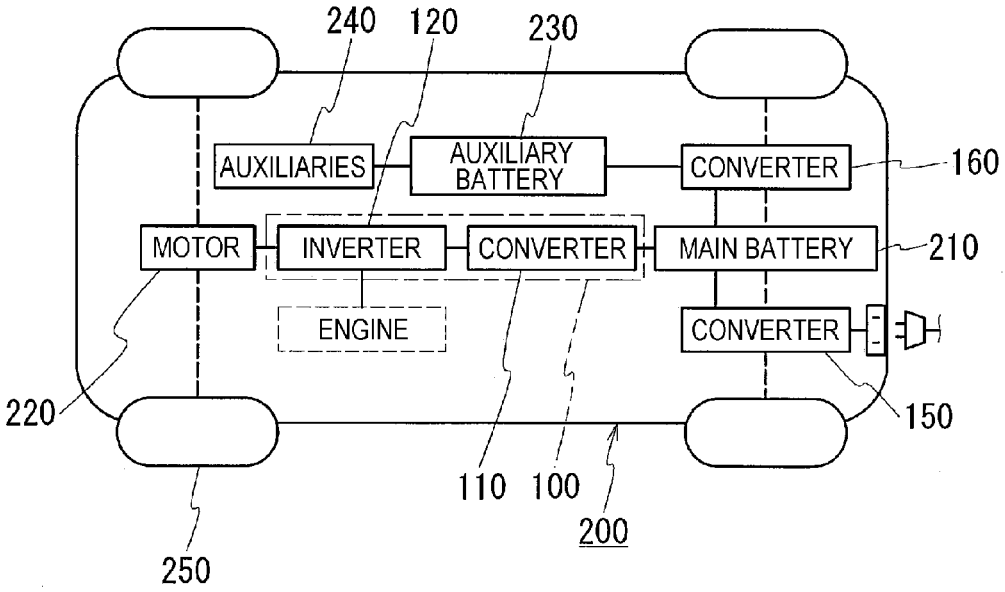
FIG. 5 is a block diagram schematically illustrating a power supply system of a hybrid car.

As illustrated in FIG. 5, for example, a vehicle 200, e.g., a hybrid car or an electric car, includes a main battery 210, a power conversion device 100 connected to the main battery 210, and a motor (load) 220 that is driven with electric power supplied from the main battery 210 to run the vehicle 200. The motor 220 is typically a 3-phase alternating current (AC) motor, which drives wheels 250 during running and which functions as a generator during regeneration. In the case of a hybrid car, the vehicle 200 includes an engine in addition to the motor 220. While FIG. 5 illustrates an inlet as a charging port of the vehicle 200, the vehicle 200 may include a plug.

The power conversion device 100 includes a converter 110 connected to the main battery 210, and an inverter 120 connected to the converter 10 and performing inter-conversion between DC and AC. The converter 110 in the illustrated example steps up a DC voltage (input voltage) of the main battery 210 in the range of about 200 V to 300 V to about 400 V to 700 V during running of the vehicle 200, and supplies the stepped-up voltage to the inverter 120. During regeneration, the converter 110 steps down a DC voltage (input voltage), which is output from the motor 220 through the inverter 120, to a DC voltage adapted for the main battery 210 for charging into the main battery 210. The inverter 120 converts the DC stepped up by the converter 110 to a predetermined AC and supplies the AC to the motor 220 during running of the vehicle 200. During regeneration, the inverter 120 converts an AC output from the motor 220 to a DC and outputs the DC to the converter 110.

Figure 6:
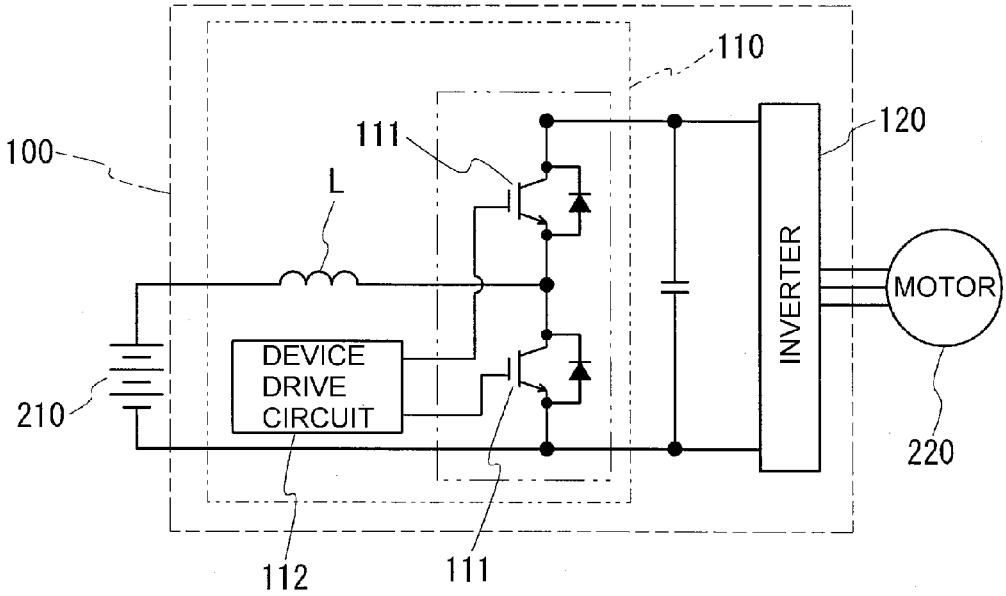
FIG. 6 is a schematic circuit diagram illustrating one example of a power conversion device of the present invention, which includes a converter of the present invention.

As illustrated in FIG. 6, the converter 110 includes a plurality of switching elements 111, a drive circuit 112 for controlling operations of the switching elements 111, and a reactor L, to thereby perform conversion (here, stepping-up and -down) of an input voltage with ON/OFF repetition (i.e., switching operations). Power devices, such as Field Effect Transistors (FETs) or Insulated Gate Bipolar Transistors (IGBTs), are used as the switching elements 111. The reactor L has the function of, when a current is going to be increased and decreased with the switching operations, smoothing change of the current by utilizing the properties of a coil, which act to impede the change of the current going to flow through a circuit. One of the reactors of Embodiments 1 to 4 is used as the reactor L. Because of including one of those reactors having the good heat dissipation effect, the power conversion device 100 and the converter 110 also have the good heat dissipation effect.

In addition to the converter 110, the vehicle 200 includes a power-feeder converter 150 connected to the main battery 210, and an auxiliary power-supply converter 160, which is connected to an auxiliary battery 230, serving as a power source for auxiliaries 240, and further connected to the main battery 210, and which converts a high voltage of the main battery 210 to a low voltage. The converter 110 typically performs DC-DC conversion, while the power-feeder converter 150 and the auxiliary power-supply converter 160 perform AC-DC conversion. The power-feeder converter 150 may perform DC-DC conversion in some cases. Reactors constructed similarly to the reactors of Embodiments 1 to 4 and having sizes and shapes, which are modified as appropriate, can be utilized as reactors in the power-feeder converter 150 and the auxiliary power-supply converter 160. Furthermore, any of the reactors of Embodiments 1 to 4 can be utilized in a converter for converting an input power, specifically a converter for performing only the stepping-up operation or a converter for performing only the stepping-down operation.

It is to be noted that the present invention is not limited to the above-described embodiments, and that the present invention can be modified as required without departing from the gist of the invention.

As other forms of the reactor having the good heat dissipation effect, the reactor may be constructed as follow.

(Annex 1)

A reactor comprising one coil formed by winding a wire, a magnetic core arranged inside and outside the coil and forming a closed magnetic circuit, and a case for housing an assembly of the coil and the magnetic core, wherein the coil is constructed and arranged such that the coil has an end surface shape that is non-circular and that includes a curved portion, the coil is housed in the case with an axial direction of the coil being parallel to an outer bottom surface of the case, the outer bottom surface serving as an installation surface, and a part of an outer peripheral surface of the coil is covered with the magnetic core, and at least a portion of a remaining part thereof not covered with the magnetic core is contacted with an inner bottom surface of the case.

(Annex 2)

The reactor stated in Annex 1, wherein, of the magnetic core, an outer core portion covering the part of the outer peripheral surface of the coil is made of a mixture containing magnetic powder and resin.

(Annex 3)

The reactor stated in Annex 1 or 2, wherein the magnetic core includes an inner core portion arranged inside the coil, and an outer core portion covering the part of the outer peripheral surface of the coil, the inner core portion being formed of a powder compact.

A magnetic core in any form selected from a stack of plural electric steel sheets, a power compact, a molded and hardened body, and combinations of the formers can be employed in the reactors of the above annexes 1 to 3.

INDUSTRIAL APPLICABILITY

The reactor of the present invention can be suitably employed as various reactors (including a vehicle-loaded component, a component in power generating or transforming equipment, etc.). In particular, the reactor of the present invention can be employed as a component of a power conversion device, such as a DC-DC converter, which is mounted on a vehicle, e.g., a hybrid car, an electric car, or a fuel cell car. The converter of the present invention and the power conversion device of the present invention can be applied to variety of uses including vehicles, power generating or transforming equipment, etc.

REFERENCE SIGNS LIST

1 reactor
2 coil
2*w* wire
2*c* coil molded product
21 semicircular arc portion
22 linear portion
23 inner resin portion
23*e* end surface
3 magnetic core
31 inner core portion
32 outer core portion
33 insulating member
4 case
41 bottom wall 41*i* inner bottom surface
41*o* outer bottom surface
42 sidewall
43 pedestal
44 coil groove
45 mounting portion
45*h* bolt hole
100 power conversion device
110 converter
111 switching element
112 drive circuit
120 inverter
150 power-feeder converter
160 auxiliary power-supply converter
200 vehicle
210 main battery
220 motor
230 auxiliary battery
240 auxiliaries
250 wheel

The invention claimed is:

1. A reactor comprising one coil formed by winding a wire, a magnetic core arranged inside and outside the coil and forming a closed magnetic circuit, and a case for housing an assembly of the coil and the magnetic core, wherein the coil is constructed and arranged such that the coil has an end surface shape that is non-circular and that includes a curved portion, the coil is housed in the case with an axial direction of the coil being parallel to an outer bottom surface of the case, the outer bottom surface configured to be cooled by an installation target, and a part of an outer peripheral surface of the coil is covered with the magnetic core, and at least a portion of a remaining part thereof not covered with the magnetic core is contacted with an inner bottom surface of the case, and wherein the magnetic core includes an inner core portion arranged inside the coil, and an outer core portion covering the part of the outer peripheral surface of the coil, the inner core portion being formed of a powder compact, the outer core portion being made of a mixture of magnetic powder and resin, and the inner core portion has a higher saturation magnetic flux density than the outer core portion, and the outer core portion has a lower magnetic permeability than the inner core portion; and wherein the inner bottom surface of the case includes a pedestal on which the coil is disposed, the pedestal including a coil groove formed following a part of the outer peripheral surface of the coil.

2. The reactor according to claim 1, wherein end surfaces of the inner core portion are flush respectively with end surfaces of the coil, or wherein one of the end surfaces of the inner core portion is flush with one of the end surfaces of the coil and the other end surface of the inner core portion projects from the other end surface of the coil, or wherein the end surfaces of the inner core portion project respectively from the end surfaces of the coil.

3. The reactor according to claim 1, wherein the end surface shape of the coil has a race track shape made up of a pair of semicircular arc portions and a pair of linear portions interconnecting the pair of semicircular arc portions, and wherein at least the linear portion is contacted with the inner bottom surface of the case.

4. The reactor according to claim 1, further comprising an inner resin portion made of an insulating resin and covering at least a part of a surface of the coil to hold a shape of the coil, wherein the coil is contacted with the inner bottom surface of the case through the inner resin portion interposed therebetween.

5. The reactor according to claim 1, wherein the coil is fixed to the case using an adhesive.

6. A converter comprising a switching element, a drive circuit for controlling operation of the switching element, and a reactor for smoothing the switching operation, the converter converting an input voltage with the operation of the switching element, wherein the reactor is the reactor according to claim 1.

7. A power conversion device comprising a converter for stepping up and down an input voltage, and an inverter connected to the converter and inter-converting a direct current and an alternating current, the power conversion device driving a load with electric power converted by the inverter, wherein the converter is the converter according to claim 6.

8. The reactor according to claim 1, wherein the inner core portion is the powder compact which is obtained by compacting magnetic powder under pressure, the outer core portion is a molded and hardened body that is made of the mixture of magnetic powder and resin, and the magnetic powder is a powder made of iron-based materials or Fe-based alloy materials containing Fe as a main ingredient.

9. The reactor according to claim 1, wherein the outer core portion includes filler.

* * * * *